US010188576B2

(12) United States Patent
Pena

(10) Patent No.: US 10,188,576 B2
(45) Date of Patent: Jan. 29, 2019

(54) PIN COVER FOR AN INVERSION TABLE

(71) Applicant: Donrobert Pena, City of Industry, CA (US)

(72) Inventor: Donrobert Pena, City of Industry, CA (US)

( * ) Notice: Subject to any disclaimer, the term of this patent is extended or adjusted under 35 U.S.C. 154(b) by 0 days.

(21) Appl. No.: 15/603,832

(22) Filed: May 24, 2017

(65) Prior Publication Data

US 2018/0338882 A1 Nov. 29, 2018

(51) Int. Cl.

| | |
|---|---|
| ***A61H 1/02*** | (2006.01) |
| ***A63B 26/00*** | (2006.01) |
| *A63B 23/00* | (2006.01) |

(52) U.S. Cl.

CPC ..... *A61H 1/0292* (2013.01); *A63B 26/00* (2013.01); *A61H 2203/0493* (2013.01); *A61H 2205/081* (2013.01); *A63B 2023/006* (2013.01)

(58) Field of Classification Search

CPC ..... A61H 1/0292; A61H 2203/0493; A61H 2205/081; A63B 26/00; A63B 2023/006; A63B 21/4035; A63B 21/068; A63B 23/00; A63B 21/4029; A63B 23/0233; A63B 21/4047; A63B 23/02

USPC ..... 482/144

See application file for complete search history.

(56) References Cited

U.S. PATENT DOCUMENTS

D273,983 S 5/1984 McGowen
4,531,731 A * 7/1985 Law ..... A61H 1/0218 482/144
5,102,121 A 4/1992 Solow et al.
5,551,937 A * 9/1996 Kwo ..... A61H 1/0229 482/144
6,679,818 B2 * 1/2004 Hsien ..... A63B 21/068 482/144
7,112,167 B2 9/2006 Kim
7,125,372 B1 10/2006 Teeter et al.
7,500,939 B2 * 3/2009 Chen ..... A61H 1/0218 482/144
7,585,264 B1 * 9/2009 Wang ..... A61H 1/0218 482/144
7,625,327 B1 * 12/2009 Teeter ..... A61H 1/0218 482/144
D617,855 S 6/2010 Leier et al.
7,867,154 B2 * 1/2011 Teeter ..... A61H 1/0218 482/144
D650,025 S 12/2011 Leier et al.
D650,026 S 12/2011 Leier et al.
8,556,787 B2 * 10/2013 Leier ..... A61H 1/0222 482/144
8,932,192 B2 1/2015 Wei
(Continued)

*Primary Examiner* — Andrew S Lo
(74) *Attorney, Agent, or Firm* — Kirk A. Buhler; Buhler & Associates

(57) ABSTRACT

Improvements in a cover for a pin used in an inversion table that prevents the inversion table from rotating beyond a desired amount of rotation. The cover is secured to the fixed frame and has a slot for the rotating frame to move within the slot. The cover prevents debris, sweat, body parts, towels or clothing from entering into the locking pin area. The cover makes the inversion table safer to operate by covering a pinch-point where the rotating component of the inversion table contacts the rotation stop. The cover can take a variety of shape and material configurations to provide the coverage and protection for the user of the inversion table.

18 Claims, 4 Drawing Sheets

(56) References Cited

U.S. PATENT DOCUMENTS

| | | | | |
|---|---|---|---|---|
| 9,526,667 | B1 | 12/2016 | Wang | |
| 2003/0162639 | A1* | 8/2003 | Hsien | A63B 21/068 482/144 |
| 2004/0157709 | A1* | 8/2004 | Olson | A63B 21/00072 482/99 |
| 2007/0265150 | A1* | 11/2007 | Teeter | A61H 1/0218 482/145 |
| 2008/0261790 | A1* | 10/2008 | Chen | A61H 1/0218 482/144 |
| 2009/0124473 | A1* | 5/2009 | Teeter | A61H 1/0218 482/144 |
| 2010/0279838 | A1* | 11/2010 | Teeter | A61H 1/0218 482/144 |
| 2011/0256993 | A1* | 10/2011 | Wei | A61H 1/0218 482/144 |
| 2013/0079205 | A1* | 3/2013 | Leier | A61H 1/0222 482/144 |
| 2013/0337981 | A1* | 12/2013 | Habing | A63B 21/22 482/110 |
| 2014/0274625 | A1* | 9/2014 | Chen | A61H 1/0229 482/144 |
| 2015/0164730 | A1* | 6/2015 | Chen | A61H 1/0222 482/144 |
| 2015/0265488 | A1* | 9/2015 | Hawco | A61H 1/0222 482/144 |
| 2016/0199686 | A1* | 7/2016 | Meredity | A63B 23/03533 482/139 |

* cited by examiner

PIN COVER FOR AN INVERSION TABLE

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a pin cover for an inversion table. More particularly, the present cover encloses the pinch points where a pin is used to limit rotation of an inversion table.

Description of Related Art Including Information Disclosed Under 37 CFR 1.97 and 1.98

Inversion tables have been used for many years by people to reduce back pain and to stretch the spine. Inversion tables are essentially beds, tables or a cloth covered frame. The table is secured to a frame across the narrow mid-section of the table to allow the table to pivot across the mid-section. At one end of the table is a retention mechanism for securing the ankles of the user. One problem with these tables is that some people do not want to invert to a position where they are upside-down or want to limit the amount of rotational inversion. To prevent this from occurring a rotation stop is utilized. One of the simplest mechanisms to limit rotation is with a pin that is inserted into a hole and when the frame makes contact with the pin the rotation of the frame is stopped. One problem with this design is that it creates a pinch point where the frame makes contact with the pin. There is a high potential for pinching and injury at this rotation stop.

A number of patents and or publications have been made to address these issues. Exemplary examples of patents and or publication that try to address this/these problem(s) are identified and discussed below.

U.S. Pat. No. 6,679,818 issued on Jan. 20, 2004 to Kiang-Wen Hsien is titled Apparatus for Locking the Tilting Angle of Body Inversion Exercise Equipment. This patent discloses a locking assembly with an adjustment piece and a position piece. The adjustment piece is rotatable relative to the axial rod. The adjustment piece has a guiding slot, openings and an adjusting bar. The position piece connects to the rotatable assembly for rotating along with the rotatable assembly. The position piece has a pin that can be insert into one of the openings of the adjustment piece to lock the tilting angle of the rotatable. While this patent allows the inversion equipment to lock and limit rotation, there is nothing that protects the pinch points.

U.S. Pat. No. 7,867,154 issued on Jan. 11, 2011 to Roger C. Teeter et al. and is titled Angle Adjusting Mechanism for Tilting Inversion Exerciser. This patent discloses a guide pin that is slidably engaged in a curved channel. A plate and a panel with an anchor is engageable into the curved channel of the plate for forming a shortened moving path between the anchor of the panel and the end stop of the plate, and for limiting the guide pin of the board to slide along the shortened moving path, and a latch member changeably secures the anchor and the panel to the housing at different angular position. In this embodiment, one housing is secured to the frame, while a second housing is secured to the inversion bed.

U.S. Pat. No. 8,932,192 issued on Jan. 13, 2015 to Tsao-Kuang Wei is titled Inversion Machine. This patent discloses a supporting bracket with a brake locator, a rotating shaft, two clamping slices, a pulling rod, a spring and a cam device. The brake locator is connected to a mounting jacket that is connected to the locating sheath. The rotating shaft is connected to the other mounting jacket. This patent uses a brake to limit rotation as opposed to using pins that limit the rotation.

What is needed is pin cover for an inversion table where the pin cover is fixed to the frame and blocks fingers, towels or other items from entering into the pin cover. The pin cover disclosed in this document provides the solution.

BRIEF SUMMARY OF THE INVENTION

It is an object of the pin cover for an inversion table to be fixed with the frame of the inversion table. Fixing the cover to the inversion table minimizes parts that can rub against each other. Rubbing parts cause wear and create locations where an object, such as a towel can follow the rubbing parts and can get caught in the sliding connection. Fixing the cover to the fixed frame further fixes the orientation of the cover to protect any openings.

It is an object of the pin cover for an inversion table to have an opening for the moving frame that supports the table to freely move within the opening. The opening is oriented away from the user whereby the rotational motion of the moving table frame is away from the user and they are restricted from placing a finger in the opening. The opening is further oriented to prevent fluids from entering into the pin engagement area. While this prevents fluids from entering into the housing it further blocks objects from falling vertically into the cover.

It is an object of the pin cover for an inversion table for the pin cover to include an opening for a plurality of finite pin locations. The finite pin locations provide fixed rotation that can be set prior to inversion to limit the amount of rotation. This provides consistence to the inversion and ensures the same level of therapy for each use of the inversion table. There is a clearance opening for each pin location hole in at least one of the housing parts to allow for placement of the pins for the inversion frame to contact and stop further rotation of the inversion table.

It is another object of the pin cover for an inversion table for the pin cover to be fabricated one or more housing parts. In one contemplated embodiment the cover is made as two halves or clam shells, but as few as one to more than two housing parts are contemplated. A first shell secures to the fixed frame and the second shell is placed around the moving frame member and is then secured to the first clam shell. The two clam shell parts have overlapping surfaces to provide a seal from debris and fluid from fluid that enter into the housing.

It is still another object of the pin cover for an inversion table to have a protective lip that covers the shank of an inserted pin. The cover protects inadvertent movement of the pin and further blocks objects, such as a towel, from coming in contact with the pin shank.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
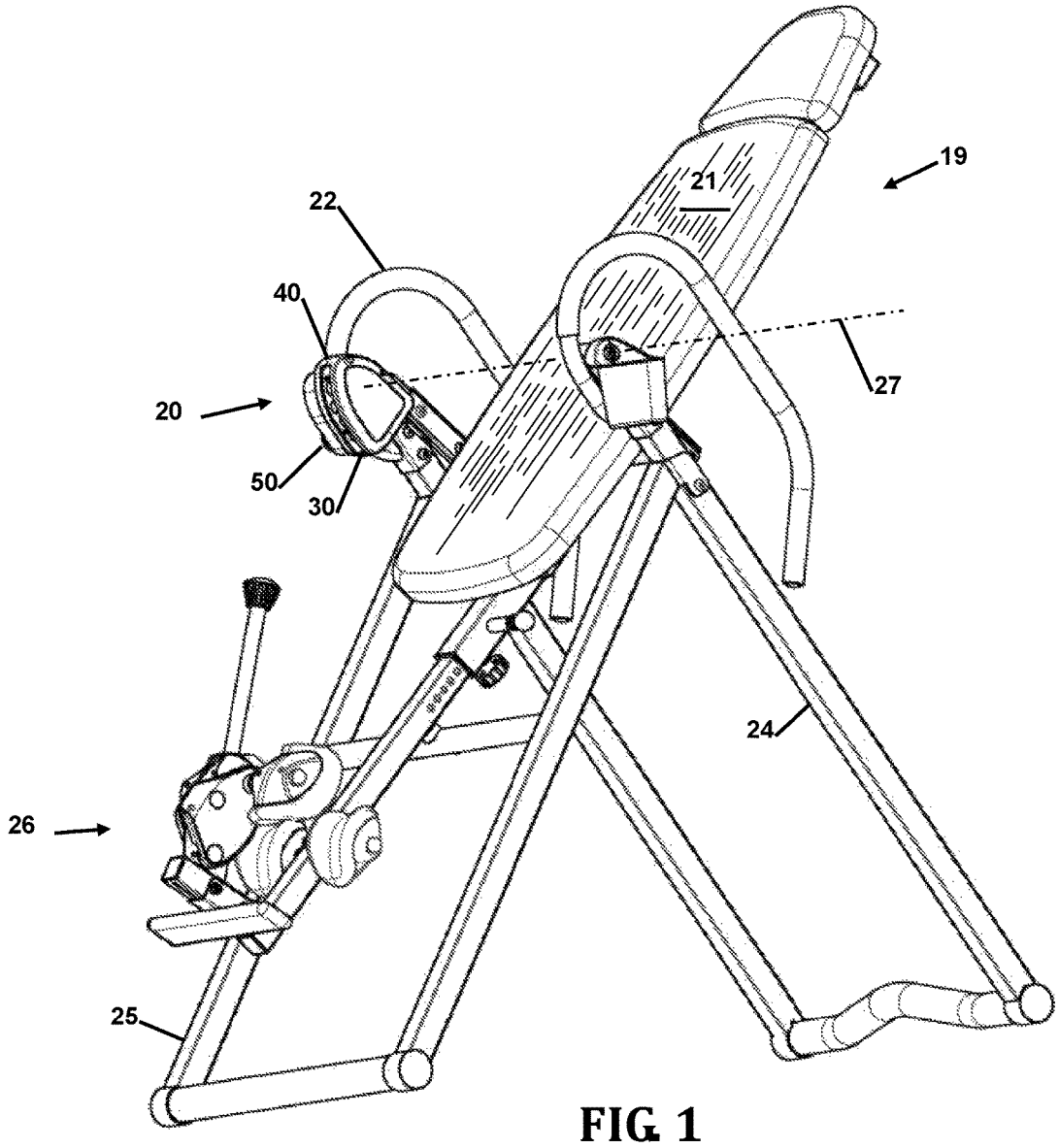
FIG. 1 shows a perspective view of an inversion table with the pin cover.

FIG. 1 shows a perspective view of an inversion table 19 with the pin cover 20. An inversion table 19 allows a person to invert themselves to reduce back stress and elongate the spine. To use an inversions table 19 a person locks their legs in the ankle holder 26. The ankle holder 26 is typically located on an adjustable frame member that allows the person to establish a desired center pivot for the rotational axis 27. Once they are secured, the user can use the arm/hand tubes 22 to invert themselves through pivot axis 27. The inversion table 21 is supported on a table pivot frame 23.

The table pivot frame 23 is secured through bearings to the main frame having a rear leg 24 and a front leg 25. The rotation of the inversion table 19 bed 21 is restricted with a pin 50 that passes through the fixed frame and prevents additional rotation of the table pivot frame 23. Because of the relationship of the table pivot frame 23, the pin 50 and the fixed frame, there is a potential for a person to get a body part, clothing or a towel caught in the pinch-point that is created between the pin 50 and the table pivot frame 23. The pin cover 20 covers and protects the interface between the fixed frame and the pivoting frame 23 as the pivoting frame 23 pivots.

To prevent the pinch point, a pin cover 20 is inserted over and around the pin 50 and the table pivot frame 23. In this preferred embodiment, the pin cover 20 has an inside housing 30 and an outside housing 40 that surrounds the interaction of the table pivot frame 23 and the pin 50. The pin cover 20 is shown and described in more detail in the accompanying figures.

Figure 2:
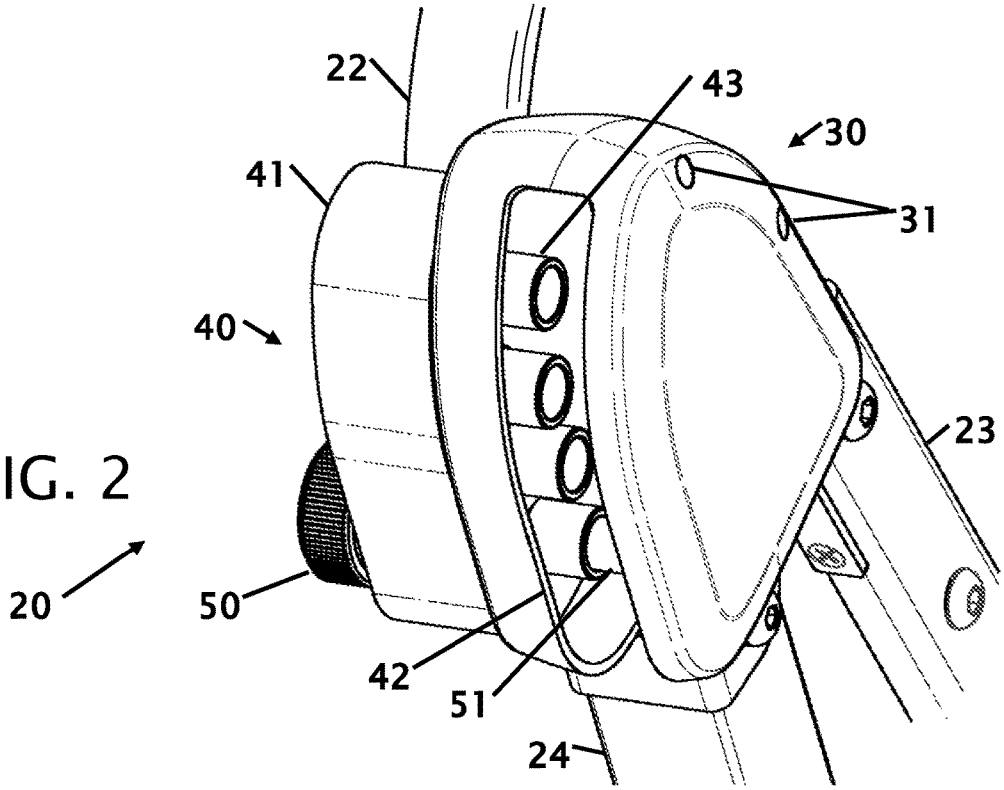
FIG. 2 shows a detailed first perspective view of the pin cover on the inversion table.
Figure 3:
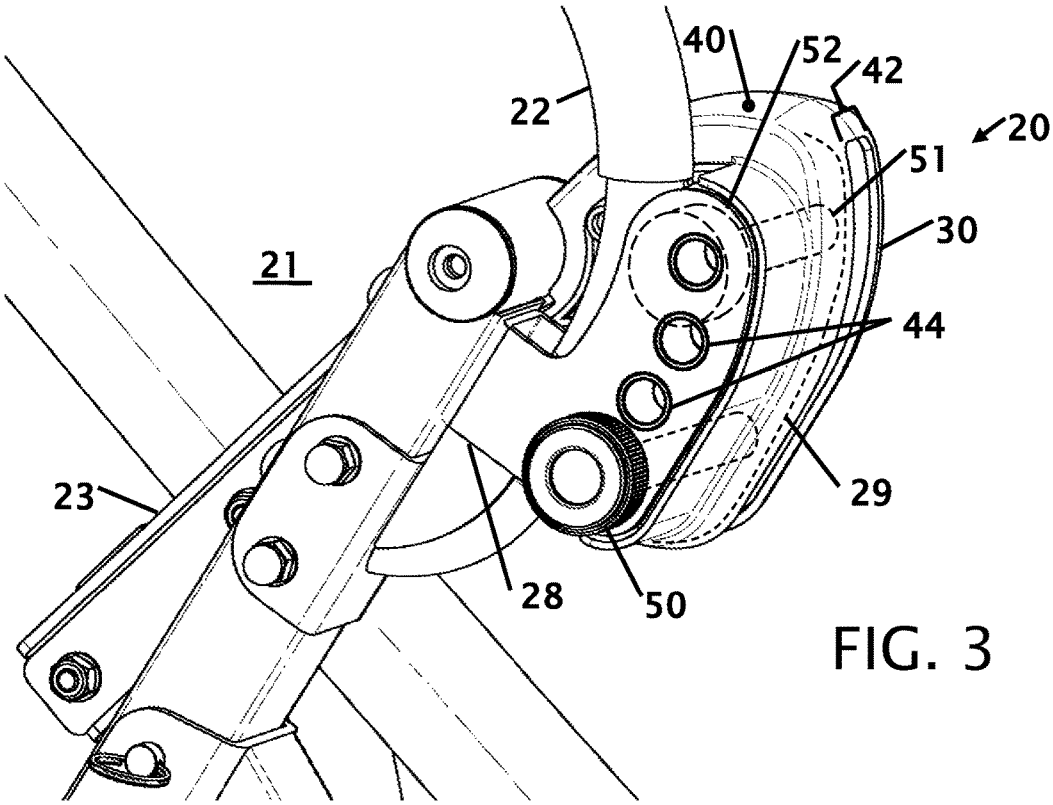
FIG. 3 shows a detailed second perspective view of the pin cover on the inversion table.

FIG. 2 shows a detailed first perspective view of the pin cover 20 on the inversion table and FIG. 3 shows a detailed second perspective view of the pin cover 20 on the inversion table. In these figures, the table pivot frame 23 is shown entering into the pin cover 20 housing. The pin cover 20 is secured to the fixed frame, the rear leg 24 and the arm/hand rail 22 are shown with the pin cover 20 connected or secured thereon.

The outer housing 40 is secured to the fixed frame and the inner housing 30 is secured to the outer housing with fasteners that pass through openings 31. The inner housing 30 and the outer housing 40 are essentially clam shells that cover the shank 51 of the pin to prevent a pinch-point that exist between the table pivot frame 23 and the shank 51 of the pin 50. The clam shell housings are preferably made from plastic, but could equally be made of metal or other materials.

The pin 50 passes through one of a plurality of concentric holes 44, as shown in FIG. 3. The concentric holes 44 are formed in an inner plate 29 and an outer plate 28. These plates are welded, screwed or otherwise secured to the fixed frame 24. A plurality of pin tubes 43 are placed through the holes 44. The shank 51 of the pin 50 is selectively placed through the desired pin tube 43 to limit rotation of the table pivot frame 23. The outer housing 40 has an outer lip 41 that extends over the pin tubes 43, the inner plate 29 and the outer plate 28. The outer lip 41 prevents intrusion of items or finger between the pin tubes 43, the inner plate 29 and the outer plate 28.

In FIG. 3, an alternative pin location 52 is shown. Movement of the table pivot frame 23 is through opening 42 that exists between the inner housing 30 and the outer housing 40. While these figures show four openings 44 for the pin, as few as a single opening 44 is contemplated to many more than locations for the rotation lock pin openings 44 are contemplated. Each additional opening 44 provides an additional rotational stop position that can be selected by a user or care giver/therapist.

Figure 4:
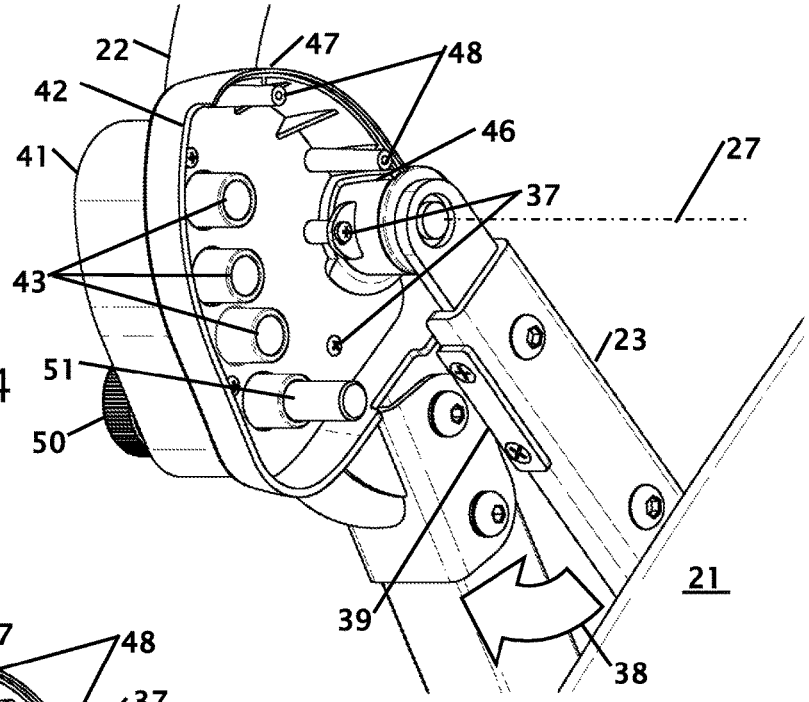
FIG. 4 shows a perspective view of the pin cover with one side removed with the supporting arm of the inversion table in a non-rotated orientation.
Figure 5:
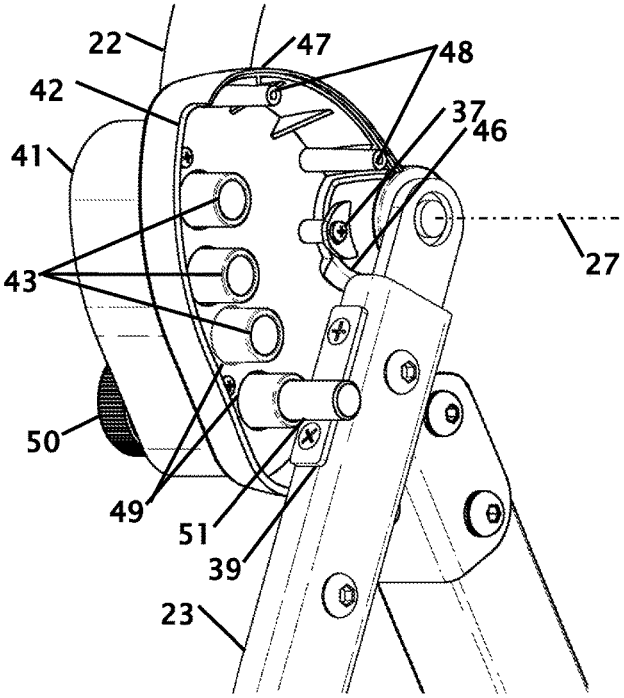
FIG. 5 shows a perspective view of the pin cover with one side removed with the supporting arm of the inversion table in a rotated orientation.

FIG. 4 shows a perspective view of the pin cover with the inside housing removed with the supporting arm 23 of the inversion table 21 in a non-rotated orientation and FIG. 5 shows a perspective view of the pin cover with the inside housing removed with the supporting arm 23 of the inversion table in a rotated orientation. In FIG. 5, the bed of the inversion table is also removed because, in this rotated orientation the bed would block the view of the internal mechanism.

In these figures the arm/hand rail 22 is shown curving around and behind the outer housing. The outer housing is secured to the fixed frame 24 with fasteners 37 that pass-through holes. The fasteners that secure the inner housing (not shown in these figures) are secured in the holes 48 in the outer housing. The housings are essentially clam shells that join together and a lip 47 creates a seal for fluids, or debris from entering into the top of the housings.

The table pivot frame 23 is shown with a cushion 39 secured to the frame. The cushion "softens" the stop of the table pivot frame 23 as it rotates 38 through axis 27 and makes contact with the shank 51 of the pin 50 (as shown in FIG. 5). The table pivot frame 23 moves through the slot 42 that exists between the inner and outer housings. The slot 42 is sized to allow for minimal clearance between the table pivot frame 23 and the housings. The slot 42 is further located at a location that is away from the upper body and torso of a user to reduce a potential of a person placing a finger or other body part into the opening. The slot 42 only extends to the extreme positions where the table pivot frame 23 can be rotated.

The outer lip 41 covers the pin tubes 43 and the frame plates that secure the pin tubes 43 to the fixed frame 24. The inner housing has an opening 46 that provides clearance for a tube that holds bushings for the table pivot frame 23 to rotate through. The inner housing further has openings 49 whereby the pin tubes 43 can pass into the pin cover. The openings 49 is sized to accommodate the pin diameter or the diameters for the multiple pin locations.

Figure 6:
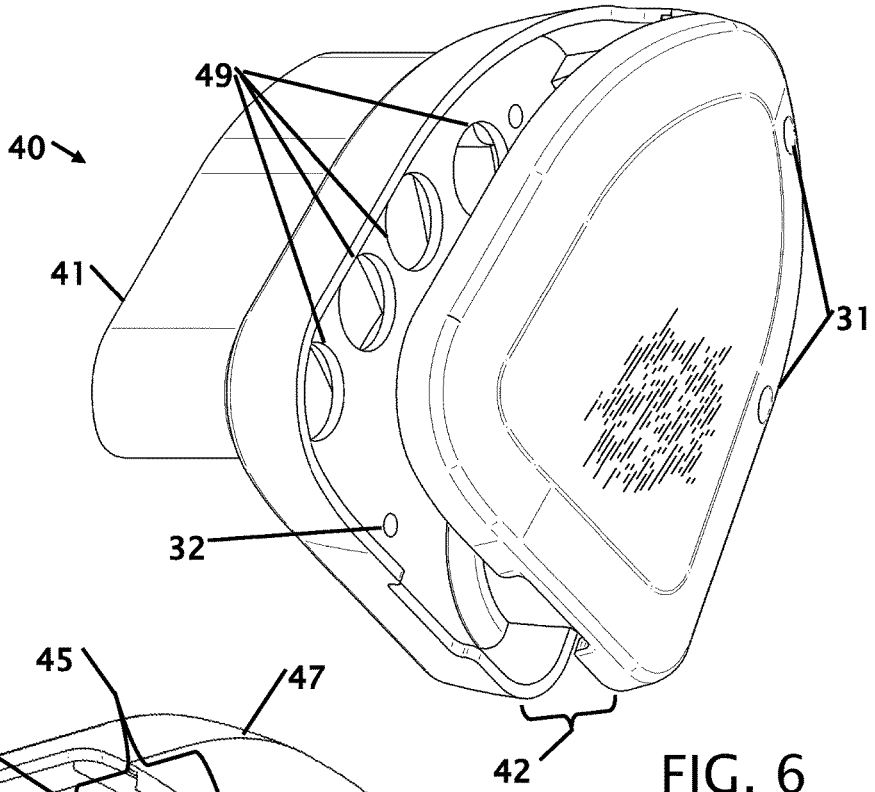
FIG. 6 shows a perspective view of the pin cover.
Figure 7:
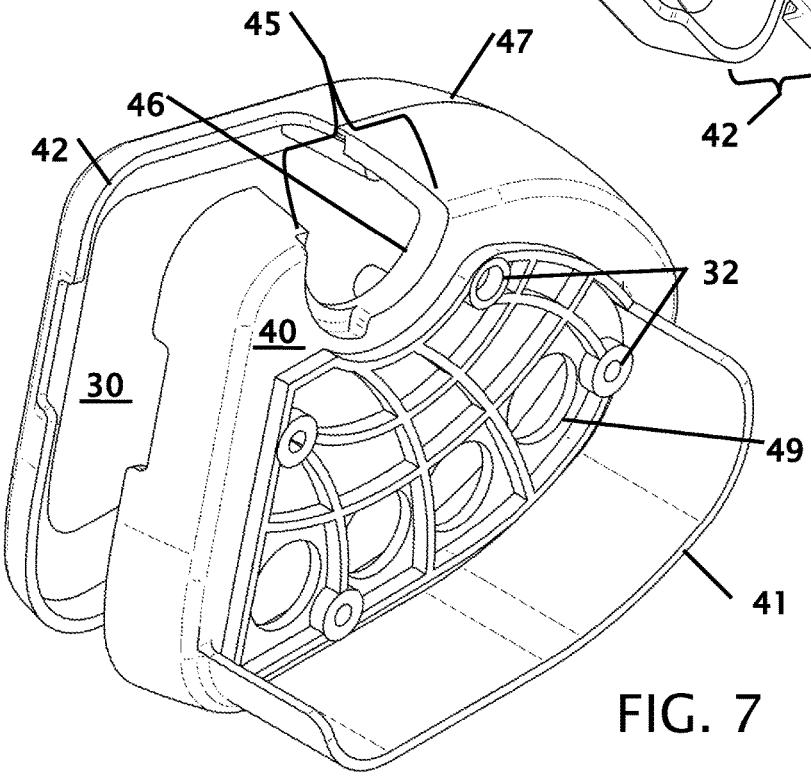
FIG. 7 shows another perspective view of the pin cover.

FIG. 6 shows a perspective view of the pin cover and FIG. 7 shows a perspective view of the pin cover. All of the inversion table components have been removed from these figures to show the features of the pin cover. The pin cover has an outer housing 40 that is secured to the frame of the inversion table with fasteners placed through holes 32. In FIG. 7, the holes 49 where the pin tubes extend is visible. While multiple holes 49 are shown, an embodiment with a single opening that encompasses all of the single openings is contemplated. It is contemplated that the multiple openings 49 can also be a single opening that allows for design changes for the number of pin tubes without changing the pin cover. The outer lip 41 covers the openings 49 and the pin tubes (not shown in these figures).

The inner housing 30 is secured to the outer housing 40 with fasteners located in openings or holes 31. When the two clam shell housings are connected together the lip 47 or seam seals the housings to prevent penetration of objects, towels or body parts through the lip 47. The assembly has an opening 42 where the moving frame member rotates with the table or bed. Another opening 46 allows for clearance where the moving frame member can rotate or pivot within this hole or opening 46. From this figure, the opening 46 is shaped with an open side. The open side 45. This open side 45 allows the inner housing 40 to be placed over the table pivot frame without removal of the table pivot frame from the fixed frame.

In relation to the previously described figures the pin cover 20 can also be used with other types of exercise or rehabilitation equipment beyond an inversion table/bed. This can include, but not be limited to weight lifting equipment. In these contemplated embodiment, the pin cover is configurable to operate on equipment with a fixed frame and a rotating frame. The pin cover 20 covers and protects the axial 27 pivot where the two frames interact or pivot. The housing has at least two mating housing parts, usually an inside housing 30 and an outside housing 40. While the terms inside an outside are used, other terminology such as upper and lower will describe essentially the same components.

These housing 30, 40 have a slot or opening whereby a portion of the rotating frame 23 rotates on an axis 27 through the pin cover 20. The pin cover 20 has at least one opening 49 whereby a repositionable pin 50, 51 is inserted to stop rotation of the rotating frame member 23. In this embodiment both the inner housing 30 and the outer housing 40 are fixed from rotating in relationship to the fixed frame 24. The outer housing 40 has an opening 46 for an axle of the rotating frame member 23. While the embodiments show the opening as a hole, the opening could also extend from or to the side of the housing. The other housing does not have openings or holes for the pins or the pivoting axis.

Thus, specific embodiments of a pin cover for an inversion table have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A pin cover for an inversion table comprising:

an inversion table;

said inversion table having a fixed frame that is axially connected to a rotating frame;

a pin cover that covers an interface between said fixed frame and said rotating frame;

said pin cover having an inner housing and an outer housing;

said pin cover further includes a slot between said inner housing and said outer housing whereby a portion of said rotating frame rotates on an axis through said pin cover;

said outer housing having at least one pin opening whereby a repositionable pin is inserted to stop rotation of said rotating frame, and both said inner housing and said outer housing are fixed from rotating in relationship to said fixed frame.

2. The pin cover for an inversion table according to claim 1 wherein said pin cover is formed from at least two mating housings.

3. The pin cover for an inversion table according to claim 1 wherein said inner housing and said outer housings are made from plastic or metal.

4. The pin cover for an inversion table according to claim 1 wherein said outer housing has an opening for an axle of said rotating frame member.

5. The pin cover for an inversion table according to claim 4 wherein said inner housing does not have an opening for said rotating frame.

6. The pin cover for an inversion table according to claim 1 wherein said outer housing is secured to said fixed frame.

7. The pin cover for an inversion table according to claim 6 wherein said outer housing is secured to said inner housing.

8. The pin cover for an inversion table according to claim 1 wherein said at least one pin opening is sized to accommodate said repositionable pin.

9. The pin cover for an inversion table according to claim 8 wherein there are at least two pin locations that limit rotation of said rotating frame.

10. The pin cover for an inversion table according to claim 1 wherein said outer housing further includes a lip that extends beyond an outer wall of said outer housing and at least partially covers at least one plate on said fixed frame whereby said repositionable pin is inserted through said outer housing.

11. A pin cover for a piece of exercise or rehabilitation equipment comprising:

a piece of exercise or rehabilitation equipment;

said piece of exercise or rehabilitation equipment having a fixed frame that is axially connected to a rotating frame;

a pin cover that covers an interface between said fixed frame and said rotating frame;

said pin cover having an inner housing and an outer housing;

said outer housing extends predominantly around an axle of said rotating frame;

said pin cover further includes a slot between said inner housing and said outer housing whereby a portion of said rotating frame rotates on an axis through said pin cover, wherein both of said inner housing and said outer housing are fixed from rotating in relationship to said fixed frame and said outer housing having at least one pin opening whereby a repositionable pin is inserted to stop rotation of said rotating frame.

12. The pin cover for a piece of exercise or rehabilitation equipment according to claim 11 wherein said pin cover is at least two mating housings.

13. The pin cover for a piece of exercise or rehabilitation equipment according to claim 11 wherein said inner housing and said outer housings are made from plastic or metal.

14. The pin cover for a piece of exercise or rehabilitation equipment according to claim 11 wherein said outer housing is secured to said fixed frame.

15. The pin cover for a piece of exercise or rehabilitation equipment equipment to claim 14 wherein said outer housing is secured to said inner housing.

16. The pin cover for a piece of exercise or rehabilitation equipment according to claim 11 wherein said at least one pin opening is sized to accommodate said repositionable pin.

17. The pin cover for a piece of exercise or rehabilitation equipment equipment to claim 16 wherein there are at least two pin locations that limit rotation of said rotating frame.

18. The pin cover for a piece of exercise or rehabilitation equipment equipment to claim 11 wherein said outer housing further includes a lip that extends beyond an outer wall of said outer housing and at least partially covers at least one plate on said fixed frame whereby said repositionable pin is inserted through said outer housing.

* * * * *